United States Patent [19]

Zarnoti

[11] Patent Number: 5,069,459

[45] Date of Patent: Dec. 3, 1991

[54] GAME APPARATUS AND METHOD

[76] Inventor: Sandor J. Zarnoti, P.O. Box 1256, Marathon, Fla. 33050

[21] Appl. No.: 613,850

[22] PCT Filed: May 11, 1990

[86] PCT No.: PCT/US90/02669

§ 371 Date: Dec. 9, 1990

§ 102(e) Date: Dec. 9, 1990

Related U.S. Application Data

[63] Continuation-in-part of Ser. No. 350,842, May 11, 1989, Pat. No. 4,986,547.

[51] Int. Cl.[5] ..... A63F 3/00

[52] U.S. Cl. ..... 273/241; 273/271; 273/283; 273/273

[58] Field of Search ..... 273/148 R, 148 A, 241, 273/271, 273, 280, 283, 290

[56] References Cited

U.S. PATENT DOCUMENTS

| | | | |
|---|---|---|---|
| D. 156,570 | 12/1949 | Smith | 273/148 R |
| 572,338 | 12/1986 | Van Kuran | 273/236 |
| 680,324 | 8/1901 | Gedge | 273/271 |
| 783,478 | 2/1905 | Strauss | 211/58 |
| 818,409 | 4/1906 | Bolton | 273/271 |
| 1,206,334 | 11/1916 | Kohler | 273/271 |
| 1,820,617 | 8/1931 | Holmberg | 273/148 R |
| 2,435,698 | 2/1948 | Running | 211/49 |
| 4,309,035 | 1/1982 | Goldfarb | 273/237 |
| 4,456,261 | 6/1984 | Daitzman | 273/271 |
| 4,497,491 | 2/1985 | Holman | 273/271 |

FOREIGN PATENT DOCUMENTS

| | | | |
|---|---|---|---|
| 738837 | 10/1955 | United Kingdom | 232/1 D |
| 2066086 | 6/1981 | United Kingdom | 273/274 |

*Primary Examiner*—Edward M. Coven
*Assistant Examiner*—Sebastiano Passaniti
*Attorney, Agent, or Firm*—Gunn, Lee & Miller

[57] ABSTRACT

The invention is a game apparatus (10) useable with numerically differentiated playing disks (16). The apparatus has multiple vertical slots (18) and horizontal recesses (19) and (21) on a playing surface (12) each for receiving a single playing disk (16). The apparatus principally includes a combination cover/playing surface (12) and a removable base (14). The two components define a storage space where playing disks (16) may be stored between uses of the apparatus (10).

10 Claims, 2 Drawing Sheets

GAME APPARATUS AND METHOD

This application is a continuation-in-part of application Ser. No. 07/350,842, filed May 11, 1989, and now U.S. Pat. No. 4,986,547.

FIELD OF THE INVENTION

Applicant's invention relates to apparatuses and methods for playing parlor games involving strategy and memory related skills.

BACKGROUND OF THE INVENTION

Many United States patents have issued for game apparatuses and methods, the use of which involve rules by which a winning player will have amassed a maximum number of points and/or will have arranged game pieces in a preferred configuration as determinable by certain nomenclature provided on the game pieces. The following U.S. Pat. Nos. are, in varying degrees, relative to such apparatuses and methods: 4,119,320 issued to Chorba et al; 4,385,763 issued to Moscovich; 3,674,274 issued to Schur; 3,866,918 issued to Goldfarb et al; 572,388 issued to Van Kuran; 680,324 issued to Gedge; 818,409 issued to Bolton; 1,206,334 issued to Kohler; and 4,497,491 issued to Holman.

A limitation common to most game apparatuses and methods is the degree to which they are suitable without modification for playing a number of different games.

SUMMARY OF THE INVENTION

It is an object of the present invention to provide a game apparatus and method which are suitable in playing a multiplicity of games.

It is another object of the present invention to provide a game apparatus and method which, though inexpensive, serve as the basis for a variety of parlor games.

It is another object of the present invention to provide a game apparatus and method which are useful in playing parlor games involving the use of playing pieces with assorted nomenclature thereon.

It is another object of the present invention to provide a game apparatus which simultaneously serves as a playing surface for parlor games and as a carrying case for playing pieces.

It is another object of the present invention to provide a game apparatus and method which are useful in playing a multiplicity of games based on the arrangement and/or accumulation of numerically differentiated game peices.

In satisfaction of these and related objectives, Applicant's invention provides a game apparatus and method which facilitate the use of a number of circular, disk-like playing pieces which are differentiated from each other by nomenclature exhibited thereon. The apparatus includes a cover/playing surface with a plurality of playing piece receptacles formed on the outer surface thereof. The cover/playing surface in conjunction with a removable base member defines a storage area wherein the game pieces may be stored and carried between uses. The game apparatus and method are suitable for use in playing a variety of games employing rules and objectives of varying difficulty to suit a wide variety of age groups and tastes.

DETAILED DESCRIPTION OF THE PREFERRED EMBODIMENT

Figure 1:
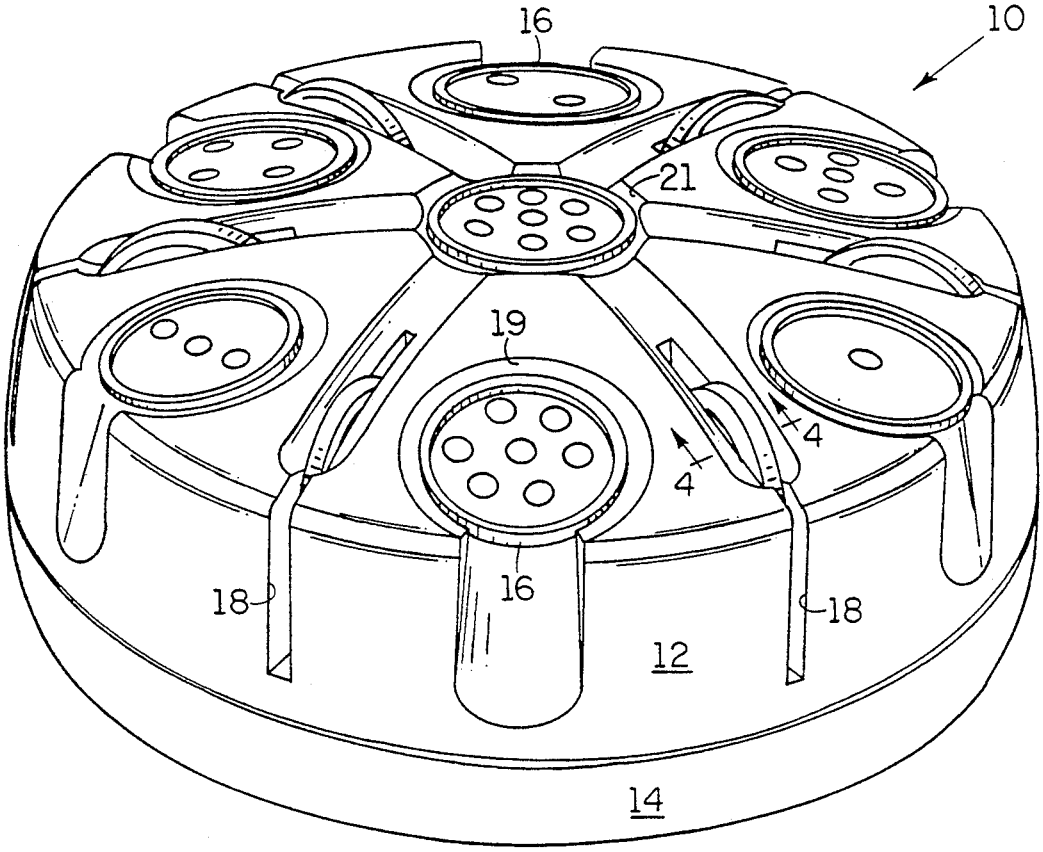
FIG. 1 is a perspective view of Applicant's fully assembled game apparatus with playing pieces shown positioned in playing piece receptacles.

Referring to FIG. 1, the fully assembled game apparatus of Applicant's preferred embodiment is identified by the reference numeral (10). The apparatus principally comprises a cover/playing surface member (12) and a base member (14). In the preferred embodiment the apparatus (10) is accompanied by a plurality of game pieces (16).

Figure 4:
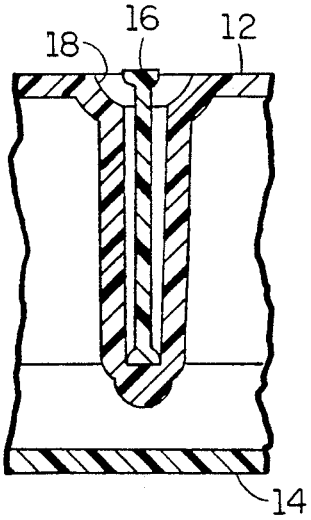
FIG. 4 is a partial cross-sectional view of FIG. 1 along line 4—4.
Figure 2A:
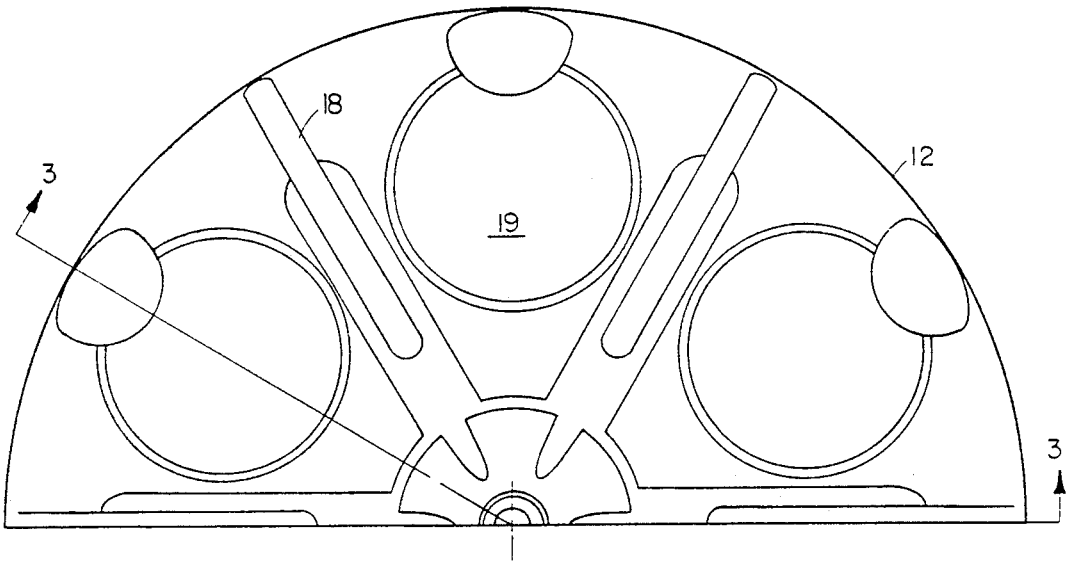
FIG. 2A is a top plan view of one half of the cover/playing surface member of Applicant's game apparatus.

Referring principally to FIGS. 1, 2A and 4, the cover/playing surface member (12) in the preferred embodiment is designed for accommodating (13) of the game pieces (16). Any one game piece (16) may be received in either one of the six vertically oriented slots (18), one of the six substantially horizontal recesses (19) around the periphery of the cover/playing surface member (12), or in the single substantially horizontally oriented recess (21) positioned at the radial center of the cover/playing surface member (12). It is noted that games rules which concentrate on use of the slots (18) demand more memory skills than rules which focus on the recesses (19) or (21).

Figure 2B:
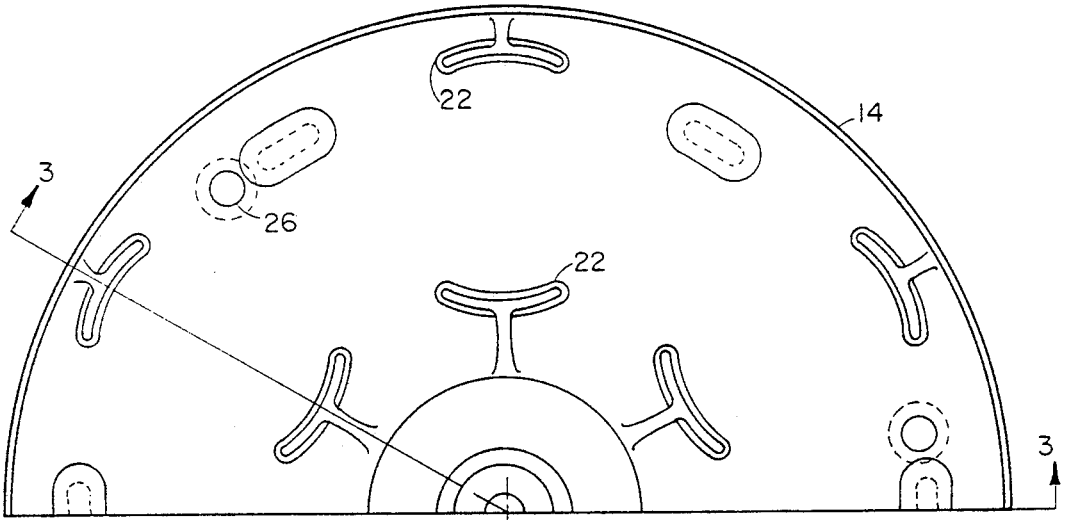
FIG. 2B is a top plan view of one half of the base member of Applicant's game apparatus with the cover/playing surface member removed.
Figure 3:
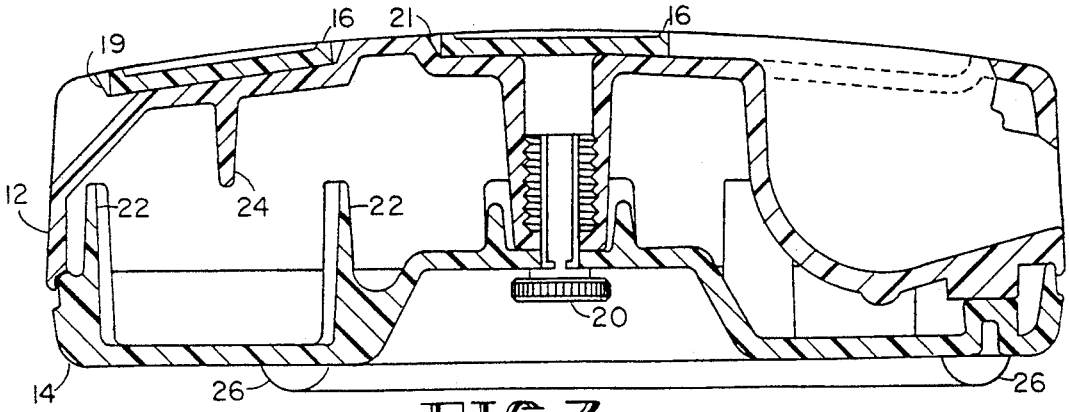
FIG. 3 is a sagittal, cross-sectional view of Applicant's fully assembled game apparatus along line 3—3 as referenced in FIGS. 2A and 2B.

Referring principally to FIGS. 2B and 3, the base member (14) is designed to be removably attached to the underside of cover/playing surface member (12) using a screw (20) and an appropriately sized and positioned threaded orifice in the base member (14). The base member (14) has, in the preferred embodiment, six paired game piece retainers (22) between which a stack of game pieces (16) may be retained between uses of the game apparatus (10). As shown in FIG. 2B, the game piece retainers (22) are formed to define an arc in horizontal cross section and to have a similar (at least as large) radius of curvature as the periphery of the game pieces (16). Of course, the game piece retainers (22) are spaced for receiving game pieces (16) therebetween.

Referring principally to FIG. 3, the cover/playing surface member (12) is formed to have a game piece retaining projection (24) positioned for centrally overlying the storage space defined by each pair of the game piece retainers (22) when the cover/playing surface member (12) and the base member (14) are mated and secured one to the other by the screw (20). This arrangement prevents the game pieces (16) from falling from the space defined by each pair of the game piece retainers (22) as the game apparatus (10) is transported or stored in other than the horizontal orientation as when it is used in play.

In the preferred embodiment, the cover/playing surface member (12) and the base member (14) are molded of a suitable plastic material. The use of plastic in manufacturing the game apparatus (10) facilitates low manufacturing costs. In addition, plastic is easily cleaned by washing or wiping with a damp cloth, thereby providing a benefit of convenience to the ultimate user.

The game pieces (16) accompanying or for use with a game apparatus (10) of the preferred embodiment are impressed with one or more circular indentations (with a maximum of seven such indentations in each disk) which indentations define the value of each chip for playing purposes, much like the indicia on dice. The use of palpable indentations as opposed to indicia limited to visual perception is directed toward the needs of potential users with impaired vision. In addition, chips of this nature have a virtually unlimited service expectancy. The preferred embodiment includes six game pieces (16) each of six game pieces (16) differentiated numerically as to point value by the above described indicia. Of course, alternative indicia not necessarily numerically related may be used depending on the particular game being played. For example, playing disks with animals or cartoon characters (not shown) may be more appropriate for children's games.

The base member (14) of the preferred embodiment includes three rubber-like feet members (26) for providing sure footing on table surface.

Applicant's game apparatus (10) is suitable for use in playing a variety of games. By varying rules pertaining to the game piece receptacles to be used; whether or not and in what configuration game pieces have preferential arrangements; the order of play; the number of participants; and the method of distributing game pieces to players; such a variety of games may be created and played using the game apparatus (10).

In the preferred embodiment of the method for playing the game there are a number of rule variations that all have as their object the identification of winning combinations of playing pieces and the collection of "winner" playing pieces for keeping score. All of these variations utilize the apparatus described wherein the playing pieces include 42 plastic chips with point values of 1-7 (six of each), three single-ring chips, and three double-ring chips.

All of these variations start by shuffling the plastic chips and arranging them face down in a tray, eight to a stack. The base and the playing wheel are placed in the center of the table.

I. METHOD FOR BASIC GAME-ADULT

A. No Slots Are Used

In this version, chips are played using top seven recesses only.

B. To Begin Play

1. The first player draws a chips from the top of any stack and places it face up in any of the six outer recesses on the playing wheel. Moving clockwise, players take turns drawing chips and placing them on the wheel until each outer recess has a chip in it.

If any single-ring or double-ring chips are drawn during this process, the player keeps the ring chip for later play (the benefit of keeping the ring chip is explained in section 6-7). If the chips is kept, that counts as a turn and play proceeds to the next player.

2. When all the other recesses are filled, the next player in turn draws a chip from any stack and places it in the center recess. This player continues his or her turn, looking for a winning combination of point values on the chips.

3. Winning Combinations. Playing off the center chip, winning combinations are determined by consecutive runs (for example, 2-3-4; 5-6-7, etc.) or by "turning the corner" (6-7-1, or 7-1-2).

4. Winning Patterns. Chips in a winning combination must be either in an adjacent triangular formation or in a straight line across the wheel, and must include the center chip.

In either formation, the point values on the chips need to be in consecutive order, but together must qualify as a winning combination. (Diagram of acceptable and unacceptable combos).

5. "Winner Chips". When the player has identified a winning combination he removes one of the chips in the outer recesses of the winning pattern and places it face down in front of him or her. This is a "winner" chip and will count toward the player's final score. The center chip is then moved to the recess vacated by the winner chip and play proceeds to the next player.

6. "Dead" Chips. If a player draws a chip for the center recess and no winning combination can be made the player takes the center chip,-now known as a dead chip and places it face up next to his or her winner chips, and forfeits the turn.

In future turns, the player may use this dead chip to make a winning combination instead of drawing from the stacks. Any unplayed dead chips are subtracted from the player's final score at the end of the game.

If during play a player removes a chip from the playing surface, incorrectly identifying it as part of a winning combination, the player must take that chip as dead chip and move the center chip to the empty space. Play then proceeds to the next player.

7. Single-Ring Chips. A single-ring chip is a "wild card" chip and may assume any numerical point value of 1-7 in order to make a winning combination. After playing a single-ring chip in the center, the player takes any outer recess chip in the winning pattern and draws another chip from the tray, or any of his or her dead chips, to take its place. The single-ring chip is then discarded as out-of-play. Play proceeds to next player.

8. Double-Ring Chips. A player drawing a double-ring chip may "steal" any two chips from any player, or one chip each from any two players, including their dead chips or any unplayed ring chips a player may be holding. The double-ring chip is then discarded as out-of-play.

9. End of Game. The game ends when the supply of chips is exhausted. Players may play any dead chip they have in turn until no more plays can be made.

10. The Winner. Players total the point value of their winning chips and subtract any dead chips. Ring chips have no value. High scorer wins.

II. METHOD FOR ADVANCED LEVEL I

The rules of the basic game apply but in this version chips are placed in all top recesses and in every other slot in no particular order. The difficulty level increases as players must rely on memory to determine whether a winning combination exists, since the point value of a chip in a slot is not visible.

Once a chip is placed in a slot, it may not be removed except when it is being played as a part of a winning combination or the player selects it as a "winner" chip. As in the basic game, the center chip then takes its place in the space or slot vacated by the winner chip.

Whenever a chip is placed in a slot the player announces its value.

A. Winning Combinations

Playing off the center chip, winning combinations are determined by consecutive runs (for example, 2-3-4; 5-6-7; etc.) or by "turning the corner" (6-7-1, or 7-1-2).

B. Winning Patterns

A triangular formation of three recesses if the slot between them is empty.

A triangular formation which must include one slot if that slot is full. A slot cannot be skipped if there is a chip in it.

Unlike the basic game, a winning pattern in a straight line across the board is not acceptable in the advanced version.

If a player incorrectly identifies a winning combination (i.e. the chip in the slot is not the one the player thought), the that chip becomes a dead chip in the player's possession, the center chip takes its place, and play proceeds to the next player.

If a winning combination cannot be made playing the top recesses, then a combination using a slot must be played.

III. METHOD FOR ADVANCED LEVEL II

The same rules apply as in Level I, but in this version chips are placed in all top recesses and in every slot in no particular order.

A. Winning Combinations

Playing of the center chip winning combinations are determined by consecutive runs (for example, 2-3-4; 5-6-7; etc.) or by "turning the corner" (6-7-1, or 7-1-2).

B. Winning Patterns

A straight line formation that includes two slots and the center chip.

A triangular formation that includes two slots and the center chip (a full recess may be skipped).

A triangular formation of one slot, one recess, and the center chip.

Unlike the basic game, a winning pattern of three recesses in a straight line across the board is not acceptable in Advanced Level II.

Winning patterns are determined by adjacent chips in both recesses and slots with the exception of the straight line formation described above. To qualify as a winning pattern, at least one slot must be included.

In advanced level play, if a player chooses a slot and discovers it does not work in the original pattern, he or she may still play the slot if it works in another configuration. If not, the chip becomes a dead chip and play proceeds.

IV. METHOD FOR CHILDREN'VERSION

For easier lay, a shorter game, or for younger players, all of the rules of the basic game apply, with the following adjustments:

No slots are used at all. Only top recesses are played.

Single-ring and double-ring chips are removed from play.

Chips in the tray stack are placed face up so that selecting a center chip that makes a winning combination is easier.

If a winning combination cannot be made using any of the visible chips in the tray stacks, the player must choose a top chip from any stack which then becomes a "dead" chip in the player's possession. It is now the next player's turn.

V. METHOD FOR OPTIONAL PLAY

What makes Slots 'N Dots unique is the many ways in which the game can be played, depending on the skill level and imagination of the players. Following are a few variations:

1. In the "7-14" variations, only winning combinations that add up to 7 or 14 are acceptable. This variation may be used in the children's game, the basic adult game, and both advanced level games. In addition to the 7-14 variations, players may elect to play the 9-15 variations or any other combination of their choosing, in which only chips adding up to the predetermined amount would qualify as a winning combinations.

2. Instead of high score determining the winner, the first player who collects four winner chips in a run (for example, 7-14; 9-15; or a consecutive run) wins.

3. Predetermine a winning score (e.g. 100) and play the necessary number of games to achieve it.

4. For tournament play, determine in advance the number of games to play in each set, the best two out of three sets wins.

5. For more than six players, teams of two or more can be formed. In advanced play, team members can consult with each other concerning the point value of chips hidden in slots.

6. For more advanced play (Level III), slots only are played no top recesses.

7. Change the mechanics of play in Advanced Level I of Advanced Level II by drawing the center chip from a slot and reloading the slot from the stack. The center chip is kept or an outer chip is removed just as in the original game depending on whether a winning combination was found.

8. Play the 11 and 21 variations but look for winning combinations using 4 chips, made up of any three adjacent chips and the center chip.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A method of playing a game comprising the steps of:

providing a first plurality of playing pieces, each of said playing pieces having indicia thereon representing a numerical value from 1 to 7 inclusive;

providing a second plurality of playing pieces, each of said second plurality of playing pieces having indicia thereon indicating a first special variety of playing piece;

providing a third plurality of playing pieces, each of said third plurality of playing pieces having indicia thereon indicating a second special variety of playing piece;

providing a game apparatus having a playing surface, said playing surface having a plurality of recesses formed therein for receiving and making visible a plurality of any of said playing pieces, said recesses comprising a center recess and a plurality of peripheral recesses;

shuffling all of said playing pieces and arranging said playing pieces face down in stacks on a level surface;

each players turn including, drawing any one of said playing pieces from any of said stacks and placing said any one playing piece face up in any of said peripheral recesses, continuing until said peripheral recesses each have one of said playing pieces deposited therein; and each players turn including, drawing any one of said playing pieces from any of said stacks and placing said any one playing piece face up in said center recess, looking for a winning combination of said playing pieces deposited on said playing surface wherein said winning combination comprises a numerically consecutive run of said playing pieces, said consecutive run occurring in a straight line across said playing surface or in an adjacent triangular formation about said playing surface.

2. The method of claim 1 wherein said winning combination further comprises runs of said playing pieces whose numerical values total specific values agreed upon by said players, said runs occurring in a straight line across said playing surface or in an adjacent triangular formation about said playing surface.

3. The method of claim 1 further comprising the steps of:

providing hidden recesses in said playing surface whereby a plurality of said playing pieces drawn from said stacks may, upon being deposited on said playing surface, be hidden from view adjacent said playing pieces in said peripheral recesses; and each players turn including, remembering a numerical value of a hidden playing piece and using said hidden playing piece, if possible, in locating one of said winning combinations.

4. The method of claim 3 further comprising the step of:

if a player incorrectly remembers a numerical value of a hidden playing piece then said hidden playing piece becomes a dead playing piece for said player, unless said hidden playing piece can still be used in a winning combination.

5. The method of claim 1 further comprising the step of:

if a player locates a winning combination of said playing pieces, said player removes one of said playing pieces in said winning combination, other than said playing piece in said center recess, and places said playing piece, as a winning piece, face down in front of him or her, moves said playing piece in said center recess into a position vacated by said winning piece just removed, draws an additional playing piece from said stack of playing pieces and places said additional playing piece in said center recess.

6. The method of claim 5 further comprising the step of:

if a player drawing a playing piece and placing said playing piece in said center recess can locate no winning combination, then said player takes said drawn playing piece and retains it face up in front of him or her as a dead playing piece, said player using said dead playing piece to complete a winning combination in future turns if said player so desires, the numerical valve of said dead playing piece being subtracted from said player's final score at an end of said game.

7. The method of claim 6 further comprising the step of:

if a player encounters a playing piece of a first special variety said playing piece assumes any numerical value from 1 through 7 inclusive that said player may need to use in forming a winning combination.

if a player draws a second special variety playing piece said player may take any two playing pieces from any other player or may take one playing piece each from any two players.

8. The method of claim 7 further comprising the step of:

totaling a point value of each of said player's winning pieces and deducting a point value of each of said player's dead playing pieces said player with a highest point value winning said game.

9. The method of claim 7 further comprising the step of:

each player's turn including looking for a game winning combination among said player's winning pieces, said game winning combination comprising a numerically consecutive run of said playing pieces.

10. A method of playing a game comprising the steps of:

providing a plurality of playing pieces, each of said playing pieces having indicia thereon representing a numerical value from 1 to 7 inclusive;

providing a game apparatus having a playing surface, said playing surface having a plurality of recesses formed therein for receiving and making visible said playing pieces, said recesses comprising a center recess and a plurality of peripheral recesses;

shuffling all of said playing pieces and arranging said playing pieces face up in stacks on a level surface;

each players turn including, drawing one of said playing pieces from any of said stacks and placing said playing piece face up in any of said peripheral recesses, continuing until said peripheral recesses each have one of said playing pieces deposited therein;

each players turn including, drawing one of said playing pieces from any of said stacks and placing said playing piece face up in said center recess, looking for a winning combination of said playing pieces deposited on said playing surface wherein said winning combination comprises a numerically consecutive run of said playing pieces, said consecutive run occurring in a straight line across said playing surface or in an adjacent triangular formation about said playing surface;

if a player locates a winning combination of said playing pieces, said player removes one of said playing pieces in said winning combination, other than said playing piece in said center recess, and places said playing piece, as a winning piece, face down in front of him or her, moves said playing piece in said center recess into a position vacated by said winning piece just removed, draws an additional playing piece from said stack of playing pieces and places said additional playing piece in said center recess;

if a player drawing a playing piece and placing said playing piece in said center recess can locate no winning combination, then said player takes said drawn playing piece and retains it face up in front of him or her as a dead playing piece, said player using said dead playing piece to complete a winning combination in future turns if said player so desires, said dead playing piece being subtracted from said player's final score at an end of said game.

* * * * *